US007287786B2

(12) United States Patent
Hillgaertner

(10) Patent No.: US 7,287,786 B2
(45) Date of Patent: Oct. 30, 2007

(54) LOCKING DEVICE FOR A VEHICLE DOOR

(75) Inventor: Klaus Hillgaertner, Wurmberg (DE)

(73) Assignee: Dr. Ing-h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 10/663,745

(22) Filed: Sep. 17, 2003

(65) Prior Publication Data

US 2004/0075284 A1 Apr. 22, 2004

(30) Foreign Application Priority Data

Sep. 20, 2002 (DE) ..... 102 43 957

(51) Int. Cl.
*E05B 3/00* (2006.01)

(52) U.S. Cl. ..... 292/336.3; 292/248; 292/DIG. 22; 292/DIG. 41; 292/DIG. 65

(58) Field of Classification Search ..... 292/336.3, 292/216, 210, DIG. 22, DIG. 23, DIG. 31, 292/DIG. 53, DIG. 65, 347, 348, 352, 354; 16/412, 110.1

See application file for complete search history.

(56) References Cited

U.S. PATENT DOCUMENTS 4,875,726 A * 10/1989 Thau ..... 292/337
4,883,296 A * 11/1989 Laurie ..... 292/336.3
5,377,450 A * 1/1995 Varajon ..... 292/336.3
5,860,684 A * 1/1999 Mizuki ..... 292/336.3
5,975,597 A * 11/1999 Makiuchi et al. ..... 292/336.3
6,007,122 A 12/1999 Linder et al.
6,173,535 B1 * 1/2001 Deischl et al. ..... 292/DIG. 53
6,439,626 B1 * 8/2002 Rohlfing ..... 292/336.3
6,490,894 B1 * 12/2002 Laurent ..... 292/336.3
6,523,871 B1 * 2/2003 Josserand ..... 292/347
6,530,251 B1 * 3/2003 Dimig ..... 292/336.3

(Continued)

FOREIGN PATENT DOCUMENTS

DE 19825919 A1 12/1999

(Continued)

OTHER PUBLICATIONS

European Search Report mailed Dec. 23, 2003.

*Primary Examiner*—Brian E. Glessner
*Assistant Examiner*—Christopher Boswell
(74) *Attorney, Agent, or Firm*—Crowell & Moring LLP.

(57) ABSTRACT

A locking device for a vehicle door has a lock disposed between an inside panel and an outside panel of the vehicle door fastened to the inside panel, which lock has a release lever for eliminating the locking position of the lock. An outside operating mechanism acts upon the release lever by way of a force transmission element, the outside operating mechanism having a supporting part fastened to the interior side of the outside panel and a swivelable pull handle arranged on the exterior side. In order to ensure, also in the case of relatively large-surface doors and relatively heavy outside operating mechanisms, that, when a lateral acceleration of approximately 30 g acts upon the vehicle, the locking device is not opened unintentionally, a catching device is provided adjacent to the lock within the vehicle door, which catching device, during a defined lateral acceleration acting upon the vehicle, interacts with the supporting part of the outer operating mechanism and limits a bulging of the outside panel toward the outside.

25 Claims, 4 Drawing Sheets

U.S. PATENT DOCUMENTS

| | | | | |
|---|---|---|---|---|
| 6,543,090 | B2 * | 4/2003 | Muneta | 292/336.3 |
| 6,588,813 | B1 * | 7/2003 | Marcarini et al. | 292/336.3 |
| 6,612,630 | B1 * | 9/2003 | Meinke | 292/DIG. 53 |
| 6,672,633 | B2 * | 1/2004 | Nomura et al. | 292/DIG. 53 |

FOREIGN PATENT DOCUMENTS

| | | |
|---|---|---|
| DE | 19910513 A1 | 9/2000 |

* cited by examiner

LOCKING DEVICE FOR A VEHICLE DOOR

BACKGROUND AND SUMMARY OF THE INVENTION

This application claims the priority of German patent document 102 43 957.5, filed Sep. 20, 2002, the disclosure of which is expressly incorporated by reference herein.

The invention relates to a locking device for a vehicle door, having a lock disposed between an inside panel and an outside panel of the vehicle door fastened to the inside panel, which lock has a release lever for eliminating the locking position of the lock, and having an outside operating mechanism acting upon the release lever by way of a force transmission element, the outside operating mechanism comprising a supporting part fastened to the interior side of the outside panel and a swivelable pull handle arranged on the exterior side.

Locking devices of this type are used in a plurality of vehicles. In the case of relatively large-surface vehicle doors and approximately horizontally aligned outside operating mechanisms (door handles) which can be swiveled in transverse direction of the vehicle, it is problematic that, at a high lateral acceleration of above 30 g acting upon the vehicle, the outside door panel bulges toward the outside in the area of the outside operating mechanism, whereby, under unfavorable conditions, the locking of the lock is unintentionally abolished.

It is an object of the invention to take such measures on a locking device for a vehicle door that, also in the case of large-surface vehicle doors and approximately horizontally aligned outside operating mechanisms, which can be swiveled in the transverse direction of the vehicle, at lateral accelerations of a magnitude of over 30 g, the operability security of the locking device is reliably ensured.

According to the invention, this object is achieved by a locking device for a vehicle door, comprising a lock fastened between an inside panel and an outside panel of a vehicle door which is fastened to the inside panel, said lock having a release lever for eliminating a locking position of the lock, and an outside operating mechanism acting upon the release lever by way of a force transmission element, the outside operating mechanism comprising a supporting part fastened to an interior side of the outside panel and a swivelable pull handle arranged on the exterior side, wherein a catching device is provided adjacent to the lock within the vehicle door, which catching device, during a defined lateral acceleration acting upon the vehicle, interacts with a supporting part of the outer operating mechanism and limits a bulging of the outside panel toward the outside.

Further advantageous features of the preferred embodiment of the invention are described herein.

Important advantages achieved by means of the invention are that, as a result of the arrangement of a catching device adjacent to the lock inside the vehicle door, it is ensured that, also in the case of relatively large-surface soft vehicle doors and approximately horizontally arranged outside operating mechanisms which can be swiveled in the transverse direction of the vehicle, the function of the locking device is reliably ensured at lateral accelerations of above 30 g acting upon the vehicle, because the bulging movement of the outside panel of the door in the area of the outside operating mechanism is effectively limited. The catching device according to the preferred embodiment of the invention constructed of a catch pin and a holding part has a simple cost-effective construction and is contactless in the inoperative position of the vehicle door; that is, there is also no noise, and no additional screwed connections or the like are required, so that the mounting of the outside operating mechanism is not made difficult. The catch pin is preferably provided on the supporting part of the outside operating mechanism, and the holding part is integrated in an interior door reinforcement or in the lock. During the mounting, only the catch pin of the supporting part is fitted into the receiving device of the holding part, the receiving device surrounding the catch pin at a radial distance of approximately 2 to 3 mm according to certain preferred embodiments of the invention. During a lateral acceleration, the exterior part with the outside operating mechanism fastened thereto moves toward the outside by this amount. Subsequently, the catch pin rests on the exterior edge of the receiving device and prevents the further bulging of the outside panel toward the outside.

Other objects, advantages and novel features of the present invention will become apparent from the following detailed description of the invention when considered in conjunction with the accompanying drawings.

DETAILED DESCRIPTION OF THE DRAWINGS

Figure 1:
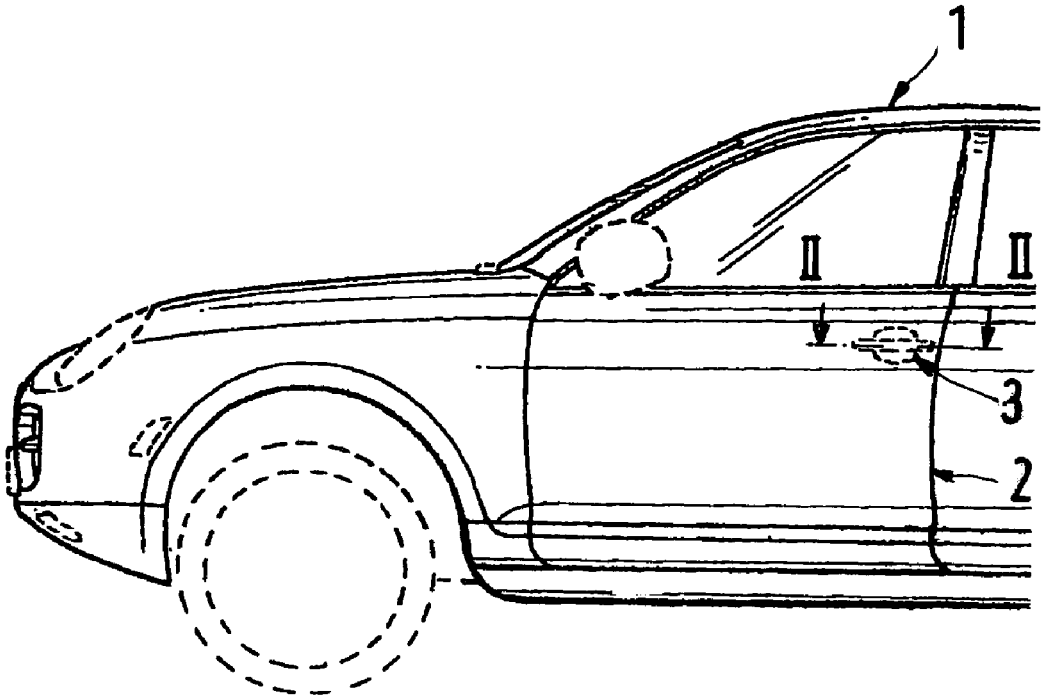
FIG. 1 is a partial lateral view of a passenger car with a vehicle door having a locking device constructed according to preferred embodiments of the present invention.

FIG. 1 illustrates a vehicle 1 formed by a passenger car, having a lateral vehicle door 2 which is provided with a locking device 3. The relative large-surface vehicle door 2 comprises an inside panel 4 and an outside panel 5, the inside panel 4 and the outside panel 5 being mutually connected on the edge side 2S by flanging or the like.

The locking device 3 has a lock 6 fastened between the inside panel 4 and the outside panel 5 to the inside panel 4, which lock 5 has a release lever 7 for eliminating the locking position of the lock 6. The release lever 7 interacts with a rotary catch which is not shown in detail and which is in an operative connection with a locking piston arranged on the adjacent stationary vehicle body part. The lock 6 is arranged adjacent to an end face side 8 of the vehicle door 2. For reinforcing the vehicle door 2, a profiled interior door reinforcement 9 is provided within the door body, which door reinforcement 9 extends, in regions, between the interior side of the inside panel 4 and the door lock 6.

The release lever 7 is connected by way of a force transmission element 10 with the outside operating mechanism 11 of the locking device 3 fastened to the outside panel, in which case the lock 6 is unlatched by a pull on the force transmission element 10. The outside operating mechanism 11 comprises a frame-type supporting part 13 fastened to the interior side 12 of the outside panel 5 and a swivelable pull handle 15 arranged on the exterior side 14. The pull handle 15 is pushed from the exterior side 14 of the outside panel 5 by means of a bearing arm 16 through a recess 17 in the outside panel 5 into an enlarged recess 18 of the supporting part 13 and by means of a shaft 19 through a recess 20 of the outside panel 5 into an enlarged recess 21 into the supporting part 13, so that a bearing receiving device 22 on the bearing arm 16 can be snapped onto a bearing bolt 23 of the supporting part 13.

Figure 2:
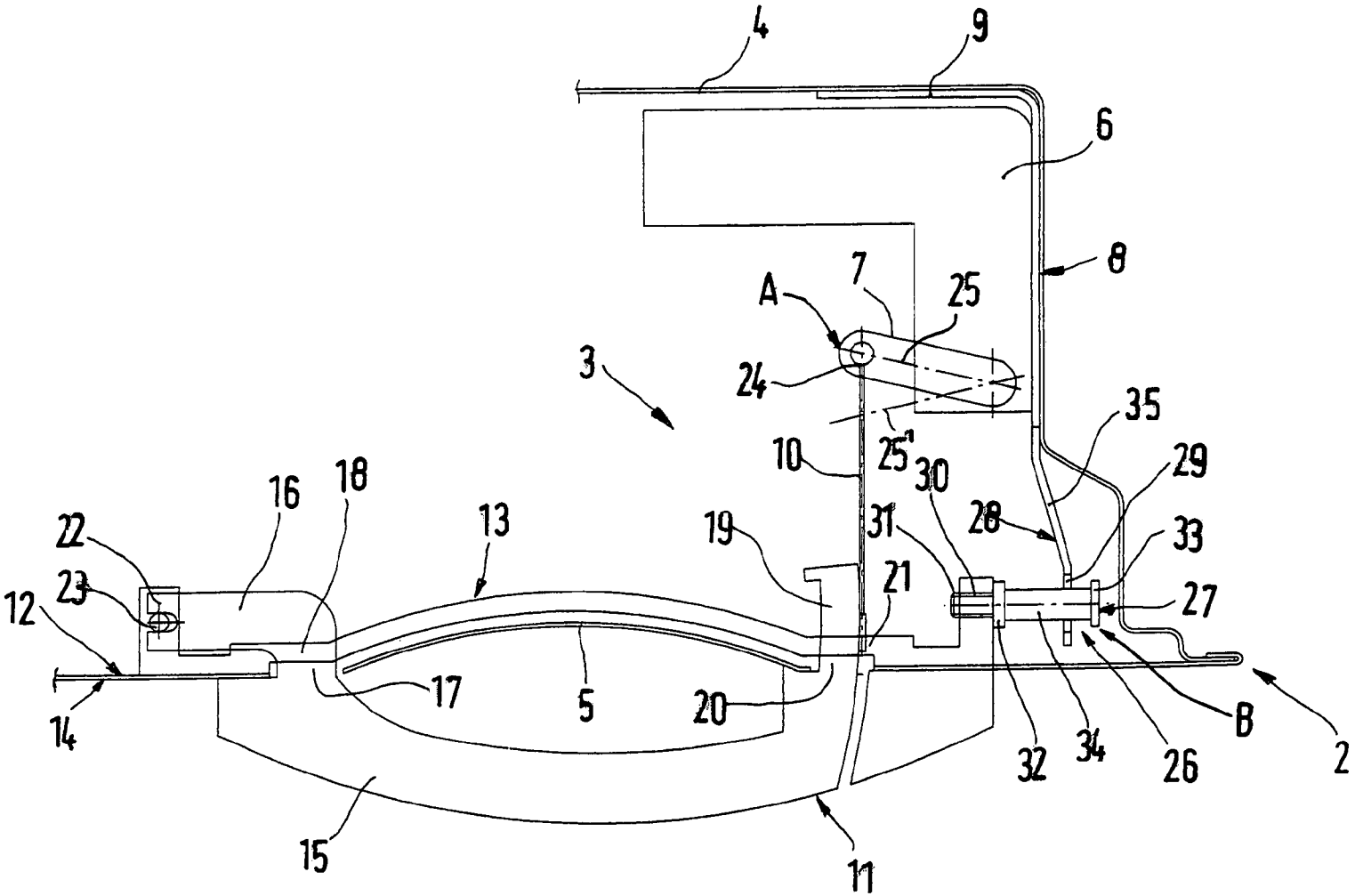
FIG. 2 is a sectional view taken along Line II-II of FIG. 1 which shows the vehicle door and the locking device with the catching device according to a preferred embodiment of the invention in the inoperative normal position.

In the embodiment shown, the force transmission element 10 is formed by a cable which, on the one side is connected with the shaft 19 of the pull handle 15 and, on the other side, is connected with the free end 24 of the release lever 10. FIG. 2 shows the locking position A of the release lever 7 with its center axis 25. In the unlocking position of the release lever 7, its center axis takes up position 25'.

Adjacent to the lock 6, a catching device 26 is provided inside the vehicle door 2, which catching device 26, in the case of a defined lateral acceleration acting upon the vehicle, interacts with the supporting part 13 of the outside operating mechanism 11 and limits a bulging of the outside panel 5 in the area of the outside operating mechanism 11 toward the outside. The catching device 26 comprises an approximately horizontally extending catch pin 27, which extends in the longitudinal direction of the vehicle, and a holding part 28 which is aligned in the transverse direction of the vehicle and has a receiving device 29 surrounding the catch pin 27. In the embodiment shown, the catch pin 27 is assigned to the supporting part 13. The catch pin 27 is either constructed in one piece with the supporting part 13 or is formed by a separately manufactured part which can be fastened to the supporting part 13. This may take place by screwing, riveting, welding or the like.

According to FIG. 2, the catch pin 27 is screwed into a threaded receiving device 30 of the supporting part 13 and, for this purpose, has an end-side external-thread section 31 which is bounded by a supporting collar 32. A pin section 34 extends between the supporting collar 32 and an end-side collar 33, which pin section 34 has a slightly smaller diameter than the collar 33 and the supporting collar 32. On the end face side, an internal polygon, which is not shown in detail, may be constructed on the collar 33 for facilitating screwing the catch pin 27 into the supporting part 13 with a tool.

The catching device 26 is provided adjacent to the lock-side face 8 of the vehicle door 2. Without any lateral acceleration of the vehicle, the receiving device 29 of the holding part 28 extends at a radial distance from the interior catch pin 27. The receiving device 29 is formed by a circular or oblong recess of the holding part 28.

According to FIG. 2, the holding part 28 is formed by a molded-on lug 35 of the interior door reinforcement 9. In the case of another embodiment, which is not shown in detail, the holding part 28 may be formed by a bent-away lug of the lock 6. The approximately upright, locally bent holding part 28, which extends in the transverse direction of the vehicle may, however, also be formed by a separate component which is locally fastened to the inside panel 4 of the vehicle door 2 or to the lock 6. According to FIGS. 2 and 3, the catch pin 27 protrudes through the receiving device 29 of the holding part 28 and projects beyond the receiving device 29 on both sides. In the inoperative position, that is, when no lateral acceleration acts upon the vehicle, the two parts 27 and 28 of the catching device 26 are arranged in a contactless manner with respect to one another.

Figure 3:
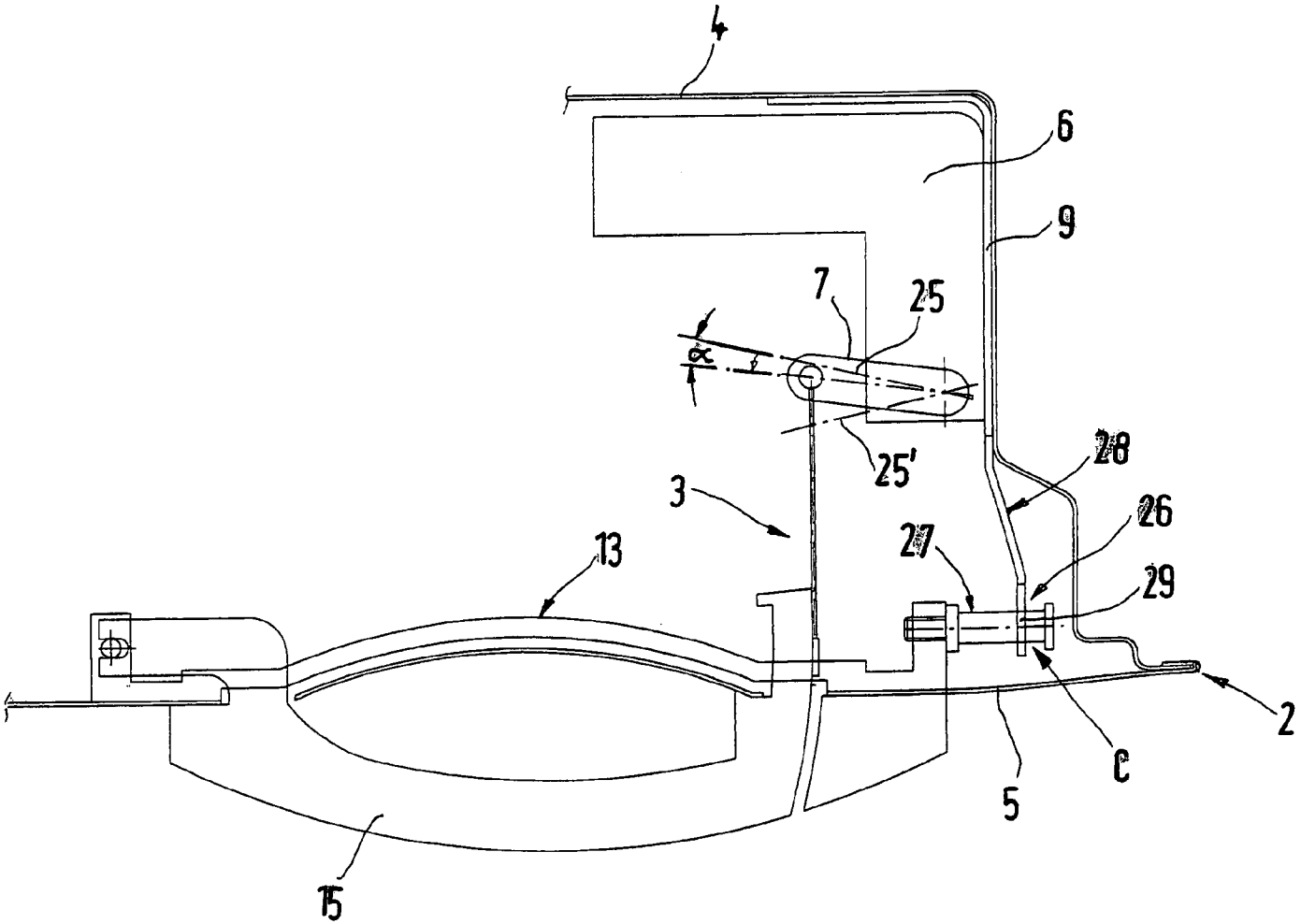
FIG. 3 is a sectional view similar to FIG. 2 but at a lateral acceleration of approximately 30 g acting upon the vehicle from the outside.
Figure 4:
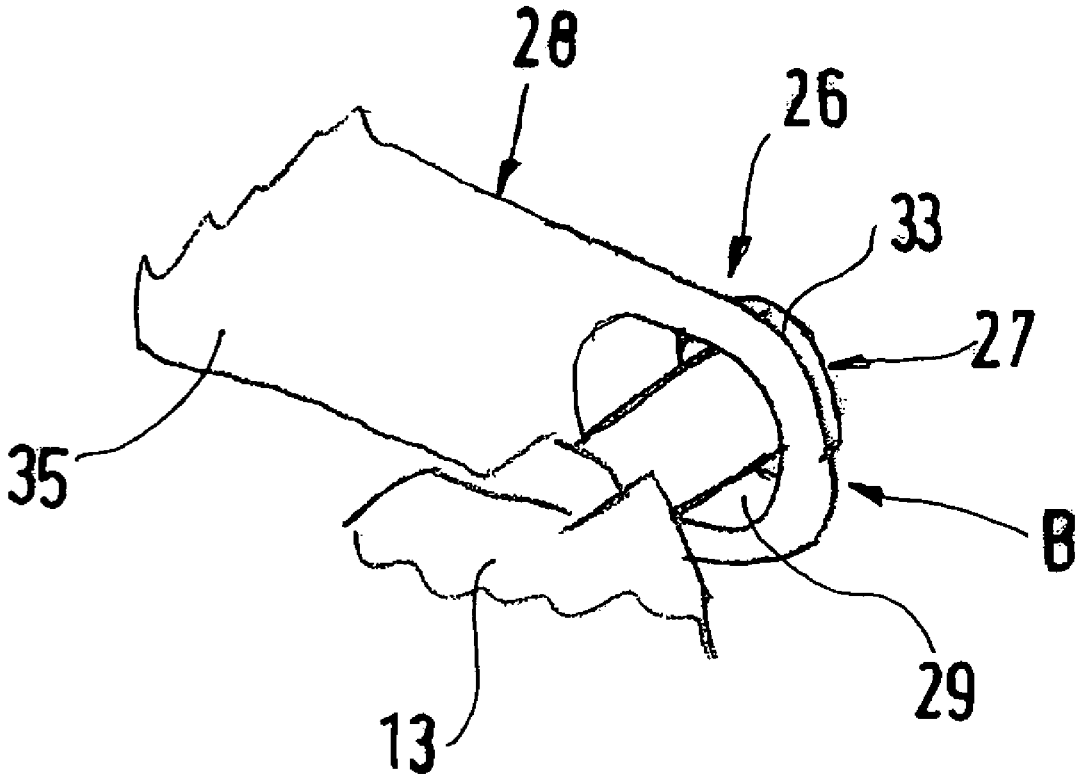
FIG. 4 is a perspective partial view of the catching device according to preferred embodiments of the invention in its inoperative position.

FIG. 3 shows the vehicle door 2 and the locking device 3 while a lateral acceleration of approximately 30 g acts upon the vehicle. The catching device 26, which is in the operative position C, permits a slight lateral bulging of approximately 2 to 3 mm of the outer door panel 5 toward the outside. In this position, the catch pin 27 will then rest on the outer edge of the receiving device 29 and will therefore limit a further bulging of the outer door panel toward the outside. As a result of the bulging of the outer door panel 5 by approximately 2 to 3 mm toward the outside, the release lever 7 swivels about the angle $\alpha$ indicated in FIG. 3. However, this angle a is so small that, as a result, no unintentional unlocking of the lock 6 will take place 6.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Locking device for a vehicle door, comprising:

a lock arranged between an inside panel and an outside panel of a vehicle door, which outside panel is fastened to the inside panel, said lock having a release lever arranged between the inside panel and the outside panel for moving the lock from a lock position of the lock to an unlocked position, and an outside operating mechanism acting upon the release lever by way of a force transmission element, the outside operating mechanism comprising a supporting part fastened to an interior side of the outside panel and a swivelable pull handled arranged on an exterior side of the outside panel, wherein a catching device is provided, as viewed in a driving direction, adjacent a rear side of the lock within the vehicle door, and is operatively connected to the inside panel such that during a defined lateral acceleration acting upon the vehicle, the catching device interacts with a supporting part of the outside operating mechanism and limits a bulging of the outside panel toward the outside, the catching device comprising a catch pin extending substantially in a longitudinal direction of the vehicle and a holding part which is aligned substantially in a transverse direction of the vehicle and has a receiving device surrounding the catch pin, and in an inoperative normal locked position of the vehicle door, the receiving device of the holding part extends at a radial distance from the interior catch pin, whereas, starting from a defined lateral acceleration acting upon the vehicle, the catch pin is locally supported on the outer edge of the receiving device.

2. Locking device according to claim 1, wherein a catch pin is provided on the supporting part.

3. Locking device according to claim 2, wherein the catch pin is constructed in one piece with the supporting part.

4. Locking device according to claim 3, wherein the holding part is formed by a molded-on lug of an interior door reinforcement.

5. Locking device according to claim 3, wherein the holding part is formed by a bent-away lug of the lock.

6. Locking device according to claim 3, wherein the holding part is fastened to the inside panel or to the lock.

7. Locking device according to claim 3, wherein the catch pin protrudes through the receiving device of the holding part and projects beyond the receiving device on both sides.

8. Locking device according to claim 2, wherein the holding part is formed by a bent-away lug of the lock.

9. Locking device according to claim 2, wherein the holding part is fastened to the inside panel or to the lock.

10. Locking device according to claim 2, wherein the catch pin protrudes through the receiving device of the holding part and projects beyond the receiving device on both sides.

11. Locking device according to claim 2, wherein the catch pin is formed by a separately manufactured part which can be fastened to the supporting part.

12. Locking device according to claim 11, wherein the holding part is formed by a molded-on lug of an interior door reinforcement.

13. Locking device according to claim 1, wherein the holding part is formed by a molded-on lug of an interior door reinforcement.

14. Locking device according to claim 1, wherein the holding part is formed by a bent-away lug of the lock.

15. Locking device according to claim 1, wherein the holding part is fastened to the inside panel or to the lock.

16. Locking device according to claim 1, wherein the catch pin protrudes through the receiving device of the holding part and projects beyond the receiving device on both sides.

17. Locking device according to claim 1, wherein the outside panel is fastened at its outer edge to an outer edge of the inside panel.

18. Locking device for a vehicle door, comprised of an inside door panel and an outside door panel fastened together, comprising a lock fastenable to the inside door panel between the inside panel and the outside door panel and having a release lever for moving the lock from a locking position thereof; an outside operating mechanism arranged to act upon the release lever via a force transmission element and comprising a supporting part fastenable to an interior side of the outside door panel and a swivelable pull handle disposed on an exterior side of the outside door; and a catching device arranged adjacent to the lock inside the vehicle door so as to be interactable with the supporting part during a defined transverse acceleration acting upon the vehicle, and thereby to limit bulging of the outside door panel away from the inside door panel exteriorly of the door, wherein the catching device comprises a catching pin extending substantially in a longitudinal direction of the vehicle and a holding part which is aligned substantially in a transverse direction of the vehicle and has a receiving device surrounding the catch pin such that in an inoperative normal locked position of the vehicle door, the receiving device of the holding part extends at a radial distance from the interior catch pin, whereas, starting from a defined lateral acceleration acting upon the vehicle, the catch pin is locally supported on the outer edge of the receiving device.

19. Locking device according to claim 18, wherein the catch pin is constructed in one piece with the supporting part.

20. Locking device according to claim 18, wherein the catch pin is formed by a separately manufactured part which can be fastened to the supporting part.

21. Locking device according to claim 18, wherein the holding part is formed by a molded-on lug of an interior door reinforcement.

22. Locking device according to claim 18, wherein the holding part is formed by a bent-away lug of an interior door reinforcement.

23. Locking device according to claim 18, wherein the holding part is fastened to the inside panel or the lock.

24. Locking device according to claim 18, wherein the catch pin protrudes through the receiving device of the holding part and projects beyond the receiving device on both sides.

25. Locking device according to claim 18, wherein the outside panel is fastened at its outer edge to an outer edge of the inside panel.

* * * * *